US005356263A

United States Patent [19]

Miller

[11] Patent Number: 5,356,263

[45] Date of Patent: Oct. 18, 1994

[54] BUCKLE ACCUMULATOR AND METHOD FOR ACCUMULATING SHEETS

[75] Inventor: Carl A. Miller, Fairfield, Conn.

[73] Assignee: Pitney Bowes Inc., Stamford, Conn.

[21] Appl. No.: 991,226

[22] Filed: Dec. 16, 1992

[51] Int. Cl.[5] ..... B65H 57/00

[52] U.S. Cl. ..... 414/790.7; 271/209; 271/220; 271/246; 271/242

[58] Field of Search ..... 271/184, 188, 209, 213, 271/220, 314, 246, 273, 274, 242; 414/789.9, 794.4, 790.2, 790.7, 794.8

[56] References Cited

U.S. PATENT DOCUMENTS

| | | | |
|---|---|---|---|
| 3,618,938 | 11/1971 | Pollak, Jr. | 271/209 X |
| 3,785,256 | 1/1974 | Nikkel | 414/790.7 X |
| 4,056,264 | 11/1977 | Dhooge et al. | 271/184 X |
| 4,453,870 | 6/1984 | Bean | 414/789.9 X |
| 4,640,506 | 2/1987 | Luperti et al. | 414/790.7 X |
| 4,750,853 | 6/1988 | Van Soest et al. | 414/789.9 |
| 5,178,379 | 1/1993 | Edwards et al. | 414/790.7 X |

FOREIGN PATENT DOCUMENTS

| | | | |
|---|---|---|---|
| 2565 | 1/1985 | Japan | 271/209 |
| 167167 | 6/1989 | Japan | 271/213 |

*Primary Examiner*—Robert P. Olszewski
*Assistant Examiner*—Boris Milef
*Attorney, Agent, or Firm*—Robert H. Whisker; Melvin J. Scolnick

[57] ABSTRACT

An accumulator for accumulating sheets of material such as sheets of paper, the sheets being of substantially any length and the accumulation being in substantially any order. The accumulator includes a mechanism for moving a sequence of sheets along a first path until the leading edges of the sheets meet a deflector which deflects the sheets onto a second path. The leading portions of the sheets pass through a retraining mechanism and are stopped by a selectively activatable mechanism such as a gate and successive sheets form an accumation at the stop mechanism. As the feed mechanism continues to feed a sheet after it is stopped, the sheet buckles in a direction determined by the angle between the first and second paths, and as the feed mechanism continues to feed the sheet the buckle grows into a loop which unrolls into a receiver, which may be no more than a space provided. As the loop continues to unroll into the receiver and the trailing edge of the sheet is released by the feed mechanism, the trailing edge of the sheet is displaced from the paths, and the next sheet may be fed. Because the trailing edge is displaced from any possible interference with the following sheet, sheets of substantially any length great enough to reach from the feed mechanism to the restraining mechanism can be fed in substantially any order without the possibility of interference between successive sheets.

20 Claims, 3 Drawing Sheets

BUCKLE ACCUMULATOR AND METHOD FOR ACCUMULATING SHEETS

BACKGROUND OF THE INVENTION

The subject invention relates to sheet accumulators. Note particularly it relates to a method and apparatus for accumulating sheets of a material such as paper having various sizes in a stack.

It is known to be desirable in the paper handling art to provide paper handling apparatus with mechanisms, known as accumulators, which accumulate a sequence of sheets being processed by the apparatus to form a stack, or accumulation, for further processing. For example, a sequence of sheets might be fed to a printer for printing of predetermined information, and the output of the printer fed to an accumulator where a predetermined number of sheets in the sequence would be accumulated, and the resulting accumulation passed on for further processing, such as folding and insertion into an envelope.

FIG. 1 shows a schematic representation of a typical prior art accumulator 10. A pair of feed rollers 12 feeds a sheet onto a guide 14. The nip of rollers 12 is offset from guide 14 by an amount O so that the trailing edge of one sheet does not interfere with the next leading edge when the next sheet is fed. Urge rollers 16 maybe provided to assure that the sheet moves along guide 14 until it reaches rollers 18. (By urge rollers herein is meant rollers designed to apply a limited force to a sheet so that the rollers will slip before the sheet buckles.) Rollers 18 are stopped, or may be counter-rotating, to provide a stop to halt the movement of the sheet along guide 14. As successive sheets are fed by rollers 12 they are positioned, because of offset O, on top of the previous sheets and are driven by rollers 16 against the nip of rollers 18 to form the accumulation. (Alternatively offset O may be replaced with a step in guide 14 to provide relief so that the trailing and leading edges of successive sheets do not interfere, and alternative mechanisms may be used in place of rollers 18 to stop the sheets and form the accumulation; for example a movable gate which is activated to stop the sheets and displaced to allow the accumulation to move on for further processing.)

Such accumulators are well known and generally function satisfactorily for their intended purpose. One disadvantage of such accumulators is, however, that the length of the sheets to be accumulated must be approximately equal to L, the distance from rollers 12 to rollers 18. Consideration of FIG. 1 quickly shows that a sheet which is substantially shorter than L might interfere with the leading edge of the next sheet, despite offset O. Conversely, a sheet which is substantially longer than L might obstruct, or even fail to clear entirely, the nip of rollers 12. At most a single, last, shorter sheet might be included with the accumulation. If a number of shorter sheets were desired a second feed mechanism 20, including second feed rollers 22 second guide 26, and second urge rollers 28 would have to be provided. Of course, for the reasons just discussed, the length of these shorter sheets would necessarily be approximately l. And, as can be seen from consideration of FIG. 1 the shorter sheets would, necessarily, be placed on top of the longer sheets fed by rollers 12. Further, it can readily be imagined how rapidly the complexity of, and space required for, an accumulator such as accumulator 10 increases as the number of different sized sheets to be accumulated increases.

FIG. 1 is believed to fairly represent prior art accumulators and the difficulties associated therewith, however those skilled in the art will recognize that numerous other configurations for accumulators are known in the prior art, all of which, however, are believed to suffer from the disadvantages described. Those skilled in the art will also recognize that the details of the mechanical design of rollers, or feedbelts, guides and stop gates, etc. as are shown in schematic form in FIG. 1 and the following Figures, are very well known in the art and further discussion of such detailed mechanical design is not believed necessary for an understanding of the subject invention.

Accordingly it is an object of the object invention to provide an accumulator having an increased capacity and flexibility for accumulating sheets of various sizes.

BRIEF SUMMARY OF THE INVENTION

The above object is achieved and the disadvantageous of the prior art are overcome in accordance with the subject invention by means of a method and apparatus which includes a feed mechanism for feeding a sheet along a first path until the sheet is deflected onto a second path. The feed mechanism continues to drive the sheet along the second path until the leading edge reaches a selectively activatable accumulating stop which halts the leading edge of the sheet. The feeder means continues to drive the sheet so that the sheet buckles away from the first path in a direction defined by the deflection of the sheet. As the feed mechanism continues to feed the sheet a loop forms and unrolls into a receiver, which may be no more than a space provided, so that as the trailing edge of the sheet clears the feeder mechanism the trailing edge and a substantial portion of the sheet are displaced from the first path. Thus the sheet may be of any length and may be followed by a next sheet of any length; limited only in that each sheet must be sufficiently long that the leading edge reaches the stop (or an intermediate set of rollers) before the trailing edge clears the feeder mechanism.

Thus it can be seen that the above object is advantageously achieved by the subject invention which provides a method and apparatus wherein sheets of substantially any length may be accumulated in substantially an order. Other objects and advantageous of the subject invention will be apparent to those skilled in the art from consideration of the attached drawings and the detailed description set forth below.

DETAILED DESCRIPTION OF THE PREFERRED EMBODIMENTS

Figure 1:
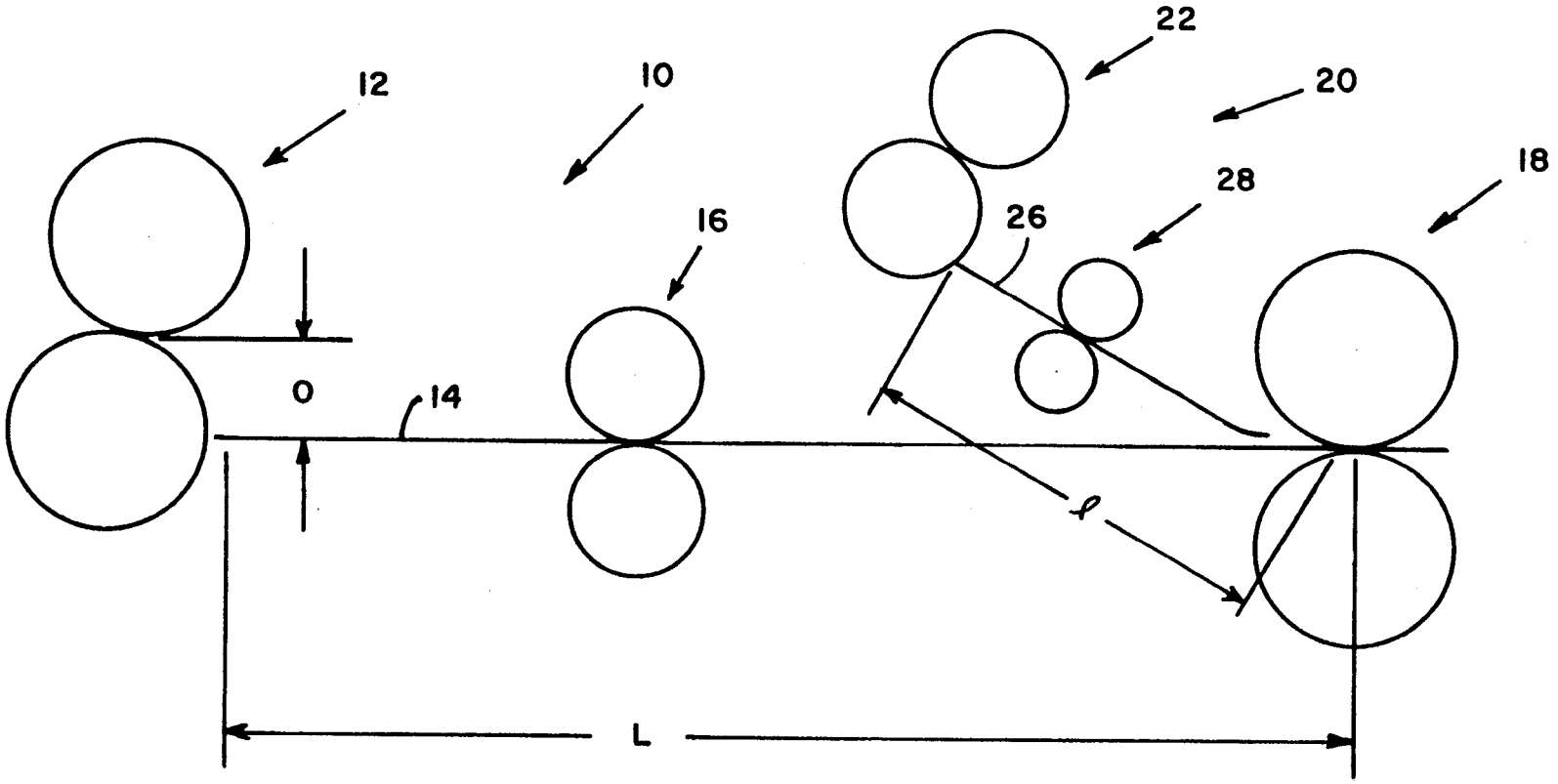
FIG. 1 (PRIOR ART)
FIG. 1 is a schematic representation of a typical prior art accumulator.
Figure 2:
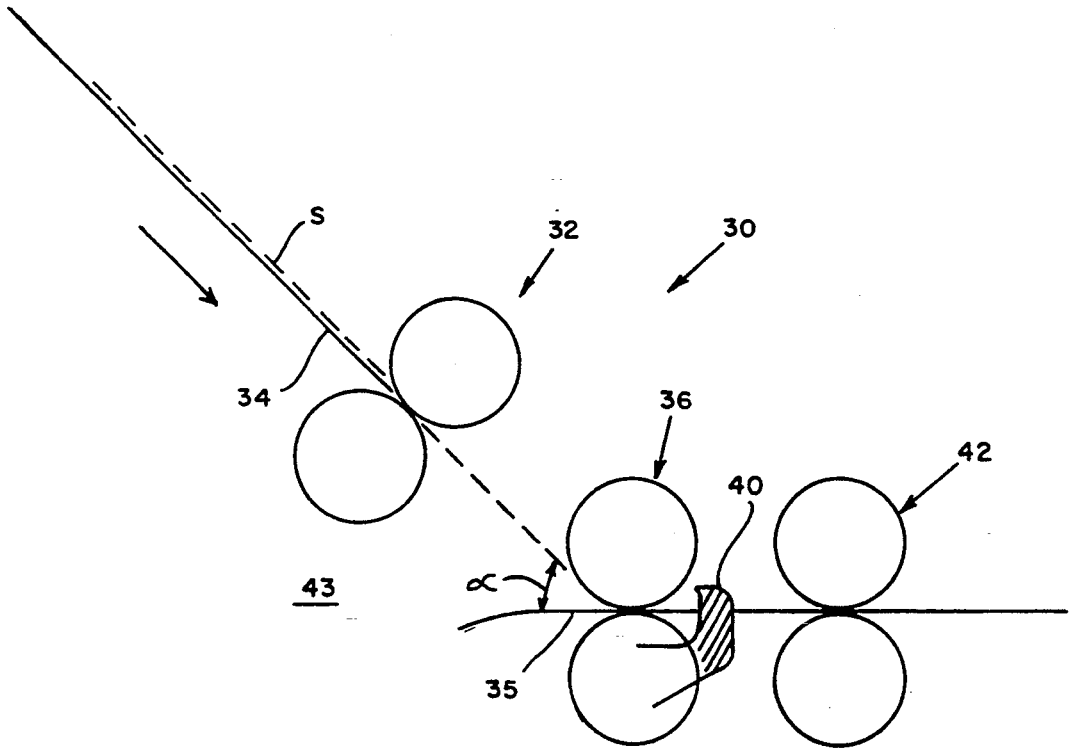
FIG. 2 is a schematic representation of one embodiment of the subject invention.

FIG. 2 shows a schematic representation of one embodiment of the subject invention. A sheet S is driven by feed rollers 32 along a first path defined by guide 34 until the leading edge of sheet S strikes guide 35, which defines a second path. The first and second paths intersect at an angle, alpha, selected so that sheet S is deflected towards restraining rollers 36 and selectively activatable stop gate 40. The leading edge of sheet S is driven by restraining rollers 36 until it reaches stop gate 40 where it is halted.

Figure 2A:
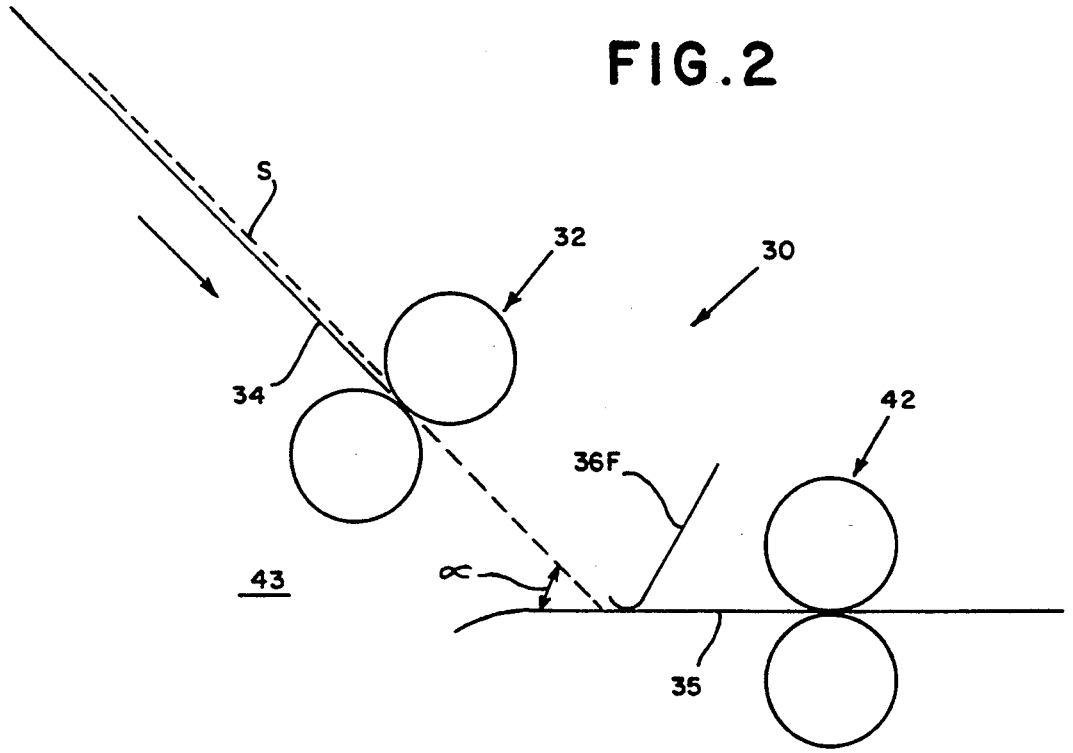
FIG. 2A is a schematic representation of another embodiment of the subject invention.

Preferably rollers 36 are urge roller designed to drive the leading edge of sheet S against stop gate 40 with a force which is limited so that sheet S does not buckle between the nip of rollers 36 and gate 40, but which is sufficient to assure that the leading edge of sheet S does not slip backward as sheet S buckles, as will be described further below. Alternatively, restraint against retrograde motion of the leading edge can be provided by flexible fingers angled 36F (shown in FIG. 2A) in the direction of motion and bearing on sheet S, or roller 36 can be selectively operable drive rollers which are stopped when sheet S reaches gate 40.

Take away rollers 42 are provided for driving the accumulation further along the second path defined by guides 35 after the accumulation is completed and stop gate 40 is deactivated and displaced from the second path. In accordance with another embodiment of the subject invention (shown in FIG. 2A) the accumulation may be formed in the nip of rollers 42 while rollers 42 are stopped or are counter-rotating.

Because the leading edge of sheet S has been deflected by guide 35, as rollers 32 continue to drive sheet S forward against stop gate 40 sheet S will buckle towards receiver 43. As can be seen from inspection of FIG. 2 receiver 43 need be no more than a clear space into which sheet S can be deflected. As rollers 32 continue to drive sheet S the buckle formed will unroll into receiver 43, as will be described further with respect to FIG. 3.

Figure 3A:
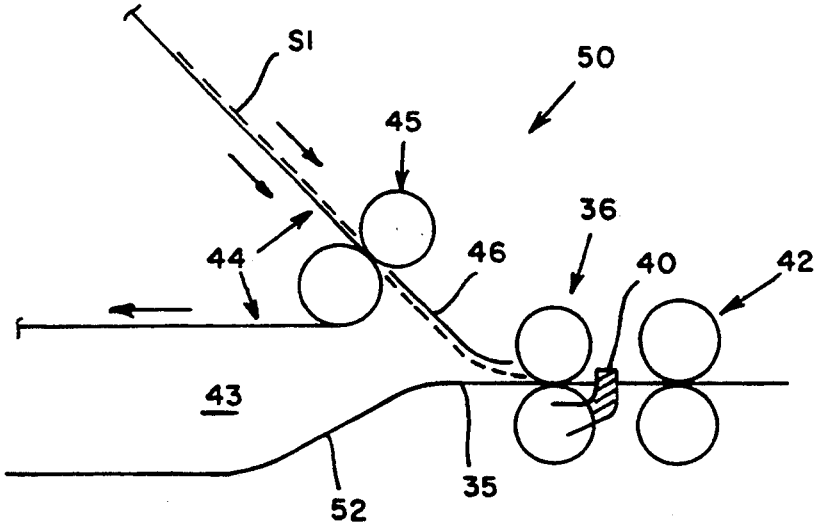
FIGS. 3A, 3B, and 3C are schematic representations of sequential stages of the operation of a second embodiment of the subject invention.
Figure 3B:
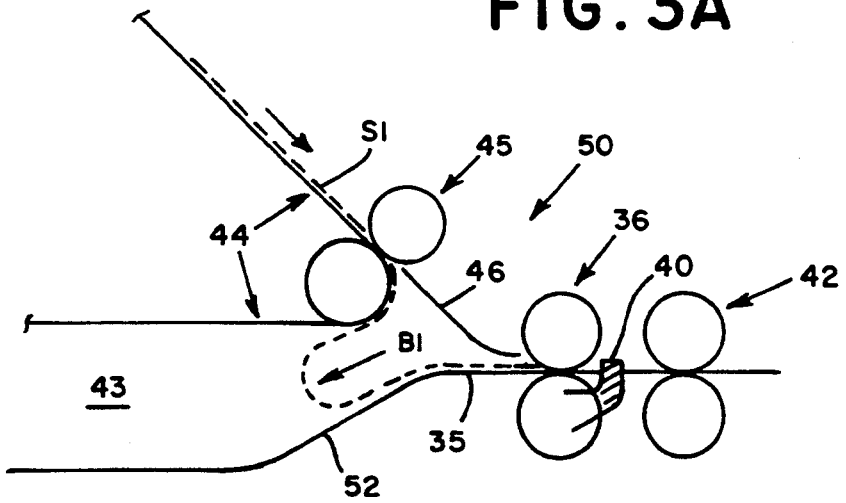
Figure 3C:
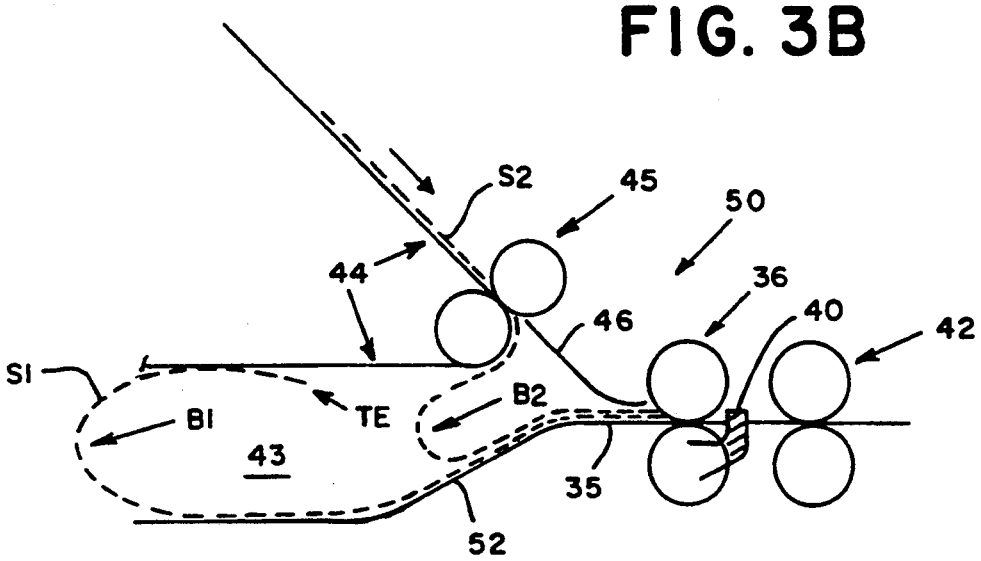

FIGS. 3A, 3B, and 3C illustrate the operation of the subject invention in a second embodiment. FIG. 3A shows an embodiment of the subject invention wherein guide 35, restraining rollers 36, stop gate 40, and takeaway rollers 42 remain unchanged, as does the basic principal of operation described with respect to FIG. 2. In the embodiment of FIG. 3A guide 34 and rollers 32 have been replaced by transport belt assembly 44 and roller 45 which define the first path followed by a sheet. FIG. 3A also shows a restraint 46 which is provided to control the leading edge of a sheet in applications where it is not feasible to position transport belt 44 and roller 45 sufficiently close to restraining rollers 36. FIG. 3A also shows support 52 which serves both to reduce the strain on restraining rollers 36 and to confine a sheet in applications where possible interference with other portions of a mechanism must be avoided.

In FIG. 3A sheet S1 has been driven along a first path by transport belt assembly 44 and roller 45 until the leading edge reaches guides 35, which deflect sheet S1 through restraining rollers 36 until the leading edge encounters stop gate 40 which is shown activated.

In FIG. 3B transport belt assembly 44 and roller 45 continue to drive sheet S one forward against the resistance of stop gate 40, inducing buckle B1 into sheet S1. Since sheet S1 is curved when it is deflected by guide 35, buckle B1 will always be towards receiver 43, as shown.

In FIG. 3C buckle B1 grows to form a loop which carries sheet S1 onto support 52. The return portion of transport belt assembly 44 assists by urging the trailing portion of sheet S1 into receiver 43. Once trailing edge TE of sheet S1 clears the nip of roller 45, a second sheet S2 may be fed into the accumulation in the same manner.

Because the trailing portions of the sheets are displaced from the paths followed by the leading edge, as has been shown in FIGS. 3A, 3B and 3C it will be apparent to those skilled in the art that sheets may be of substantially any length above the minimum required to reach from the feed rollers to the restraining rollers, and may be fed in any sequence without the possibility of interference between successive sheets.

The descriptions of preferred embodiments set forth above and in the attached drawings have been provided by way of illustration only. Other embodiments of the subject invention will be apparent to those skilled in the art from consideration of the above descriptions and the attached drawings. Accordingly limitations on the subject invention are to be found only in the claims set forth below.

I claim:

1. A sheet accumulator, comprising:

a) feed means for feeding a sheet along first path and second paths;

b) deflecting means for deflecting the leading edge of said sheet along said second path, said second path being at an angle to said first path;

c) selectively activatable accumulating stop means, in said second path, for, when activated, stopping said leading edge, whereby, as said feed means continues to drive said sheet against said stop means, said sheet buckles in a direction determined by said angle; and, d) receiving means for receiving a loop formed as said sheet buckles; whereby, e) the trailing edge of said sheet is displaced from said paths as said loop unrolls into said receiving means and the trailing edge of said sheet is released by said feed means; and whereby, f) said paths are cleared to accumulate a next sheet against said stop means.

2. An accumulator as described in claim 1, further comprising a restraining means positioned between the intersection of said paths and said stop means for allowing the leading edge of said sheet to move along said second path until it engages said stop means and for restraining the leading edge of said sheet against said stop means as said loop unrolls into said receiving means.

3. An accumulator as described in claim 2 wherein said restraining means comprises a pair of urge rollers.

4. An accumulator as described in claim 2 wherein said restraining means comprises flexible fingers angled in the direction of movement of said sheet and bearing on the top surface of said sheet.

5. An accumulator as described in claim 2 wherein said restraining means comprises a pair of selectively operable drive rollers.

6. An accumulator as described in claim 2 wherein said first path is defined, at least in part, by a feed belt assembly.

7. An accumulator as described in claim 6 wherein a return portion of said feed belt assembly urges said loop into said receiving means as said loop unrolls.

8. An accumulator as described in claim 2 wherein said stop means comprises a selectively activatable gate which is activated to stop said sheet and deactivated to allow said sheet, together with any additional sheets which have been accumulated, to move on for further processing.

9. An accumulator as described in claim 2 wherein said stop means comprises a pair of selectively driven rollers which are activated to stop said sheet by being stopped or counter-rotated and which are rotated to move said sheet, together with any additional sheets which have been accumulated, on for further processing.

10. An accumulator as described in claim 2 wherein said receiving means comprises a support for supporting said loop as it unrolls into said receiving means.

11. An accumulator as described in claim 2 wherein said restraining means comprises a pair of urge rollers.

12. An accumulator as described in claim 2 wherein said restraining means comprises flexible fingers angled in the direction of movement of said sheet and bearing on the top surface of said sheet.

13. An accumulator as described in claim 2 wherein said restraining means comprises a pair of selectively operable drive rollers.

14. An accumulator as described in claim 1 wherein said first path is defined, at least in part, by a feed belt assembly.

15. A accumulator as described in claim 14 wherein a return portion of said feed belt assembly urges said loop into said receiving means as said loop unrolls.

16. An accumulator as described in claim 1 wherein said stop means comprises a selectively activatable gate which is activated to stop said sheet and deactivated to allow said sheet, together with any additional sheets which have been accumulated, to move on for further processing.

17. An accumulator as described in claim 1 wherein said stop means comprises a pair of selectively driven rollers which are activated to stop said sheet by being stopped or counter-rotated to stop said sheet and which are rotated to move said sheet, together with any additional sheets which have been accumulated, on for further processing.

18. An accumulator as described in claim 1 wherein said receiving means comprises a support for supporting said loop as it unrolls into said receiving means.

19. A method for accumulating sheets, comprising the steps of:

a) feeding a sheet along a first path;

b) deflecting the leading edge of said sheet along a second path at an angle to said first path;

c) stopping the leading edge of said sheet as said sheet is fed along said second path, whereby said sheet buckles in a direction determined by said angle;

d) receiving a loop formed when said sheet buckles in a region displaced from said first path, whereby the trailing edge of said sheet is displaced from said paths as said loop unrolls into said region and said trailing edge clears said first path and a second sheet may be fed for accumulation with said first sheet.

20. A method as described in claim 19 comprising the further step of restraining the leading edge of said sheet against retrograde movement after it is stopped as said loop unrolls into said region.

* * * * *